United States Patent [19]

Jones

[11] 4,071,199

[45] Jan. 31, 1978

[54] APPARATUS FOR WINDING WIRE OR OTHER ELONGATE MATERIAL

[75] Inventor: Edward Owen Jones, Aughton, England

[73] Assignee: BICC Limited, London, England

[21] Appl. No.: 741,613

[22] Filed: Nov. 15, 1976

[51] Int. Cl.[2] ..... B65H 54/00

[52] U.S. Cl. ..... 242/25 A; 242/54 R

[58] Field of Search ..... 242/25 R, 25 A, 18 R, 242/18 A, 54 R, 79

[56] References Cited

U.S. PATENT DOCUMENTS

| | | | |
|---|---|---|---|
| 3,698,652 | 10/1972 | Morikawa et al. | 242/25 A |
| 3,877,653 | 4/1975 | Foltyn et al. | 242/25 A |
| 3,980,244 | 9/1976 | Pietroni | 242/25 A |

*Primary Examiner*—Leonard D. Christian

*Attorney, Agent, or Firm*—Buell, Blenko & Ziesenheim

[57] ABSTRACT

Wire emerging from a manufacturing plant, e.g., an enamelling installation, is continuously wound on a succession of reels. Reels are positioned alternately in two fixed positions and driven by torque motors. At any convenient time during the filling of one reel, the wire is looped round an empty reel in the other position and it is driven by a torque motor only sufficiently to overcome windage and other frictional forces, so that the wire controls the speed of the empty reel. When the first reel is full, the wire is cut and thereupon wound on the empty reel, the torque applied by the motor being suitably increased. A mixed sequence of reels with different barrel diameters, and including some with tapered barrels if desired, can be used.

7 Claims, 6 Drawing Figures

APPARATUS FOR WINDING WIRE OR OTHER ELONGATE MATERIAL

This invention relates to winding or spooling wire, cable or other elongate flexible members, all such flexible members hereinafter, for convenience, being included in the term "wire," on a reel or similar cylindrical support.

The invention is particularly concerned with the method of winding wire in which wire, during its passage from a processing plant or other source to a rotatably-driven reel on which it is being wound, is caused to pass partially or wholly around an empty reel which is rotatable-driven at substantially the same peripheral speed as the linear speed of the wire. When the reel being wound is fully wound with wire, the length of wire extending between the full-wound reel and the empty reel is cut and the free end of the wire travelling from the processing plant is applied to the empty reel so that the wire is now wound around the rotatably-driven reel. The fully wound reel is then brought to a standstill and is replaced by an empty reel which, at some moment in time before the reel now being wound is fully wound, is rotatably-driven at a peripheral speed substantially equal to the linear speed of the wire and is introduced into the path of the wire between the processing plant and the reel being wound in such a way that the travelling wire is caused to pass partially or wholly around the rotatably driven empty reel. This sequence of operations is repeated as each reel in turn is fully wound.

It is an object of the present invention to provide a modification of the aforesaid method of winding wire which is simple and less expensive.

In the improved method of winding wire according to the invention whilst the wire, in travelling from the processing plant or other source to the rotatably-driven take-up reel, is passing partially or wholly around the empty reel a torque is applied to the reel by a torque motor that is sufficient only to overcome windage (the effect of the surrounding air in resisting motion) and any friction in the bearings by which the reel is rotatably-supported and is rotatably-driven at a peripheral speed substantially equal to the linear speed of the wire by the wire itself passing partially or wholly around the reel. When the length of wire extending between the fully-wound reel and the empty reel is cut, the torque imparted to the empty reel by the motor is increased to such an extent that, when the free leading end of the wire is applied to the empty reel, the wire is drawn from the processing plant or other source at a tension in the required range.

The torque motor will usually be an electric torque motor, but any motor with constant-torque characteristics, for example a pneumatic turbine, a pneumatic vane motor, or a hydraulic torque motor could be used.

Preferably the steps of cutting the length of wire extending between the fully-wound reel and the empty reel, increasing the torque imparted to the empty reel by the motor or other drive means, and applying to the empty reel the free end of the wire travelling from the processing plant are arranged to occur automatically, for example when the reel being wound with wire is fully wound. The step of initially causing wire travelling from the processing plant to the take-up reel to pass partially or wholly around the empty reel is preferably effected manually by looping a length of wire travelling towards the take-up reel about the empty reel, but it may be effected automatically if desired. The moment in time when changeover from one reel to another reel should take place can be determined, for example, by time measurement having regard to the linear speed of the wire, by sensing the amount of wire on the reel being wound, or by measurement of the length of wire wound on the reel.

With a view to facilitating automatic cutting of the wire and transfer of the cut end of the wire to the empty reel, preferably the reel being wound with wire and the reel partially or wholly around which the travelling wire passes are rotatably driven in opposite directions.

The invention also includes apparatus for carrying out the method of the invention, which apparatus comprises a pair of turntables or other means for supporting a pair of reels in fixed positions in such a way that each reel can be rotatably driven about its axis; a pair of torque motors, one for driving each reel; means for guiding wire to pass partially or wholly round a reel in one of those positions and thence on to a reel in the other of those positions; means for cutting the length of wire extending between a pair of reels so supported and, associated with the same cutting means, means for engaging the said length of wire to cause it to be cut by the said cutting means and for guiding the leading cut end of the wire to the other of the reels; and means for adjusting the torque of each motor to a required value.

Preferably the wire guiding means associated with the pair of turntables or other reel support means comprises a wire guide by means of which wire travelling to the reels can be directed to one or other of the reels, and the wire guide and reel supports are preferably mounted so that the wire guide can be reciprocated relative to the reels in a direction substantially parallel to their axes of rotation ("traversed") to permit wire to be wound on one of the reels in layers of contiguous turns.

In a preferred embodiment the reel support tables are arranged side by side with their axes of rotation substantially vertical.

When the axes of the reels are vertical, the wire guide preferably comprises a fully rotatable pulley mounted in a clevis with its axis of rotation substantially horizontal, the clevis being free to pivot about a vertical axis. The wire guide preferably also includes an elongate guide which lies in a substantially horizontal plane passing through or close to the bottom of the peripheral groove of the freely rotatable pulley at the lowermost part of the pulley and which extends between the two tables in a direction substantially normal to a plane containing the axes of rotation of the tables.

The means for engaging a length of wire extending between a pair of reels supported on the tables preferably comprises at least one finger rotating with the support for the empty reel which, when brought into operation, for example when a reel is fully wound, engages the length of wire to urge it against a cutting blade to cut the wire, and retains engagement with the leading cut end of the wire to guide it to the empty reel now being rotatably-driven by its associated motor at a torque such that the wire is drawn at the required tension. The finger may be brought into operation by moving it to engage the wire or by deflecting the wire to engage the finger, in each case by a solenoid or by other means. The cutting blade may be fixed or, where the wire guide includes a substantially horizontal arm extending between the two tables, it may be carried on this arm.

The invention will be further described, by way of example, with reference to the accompanying drawings in which.

Figure 1:
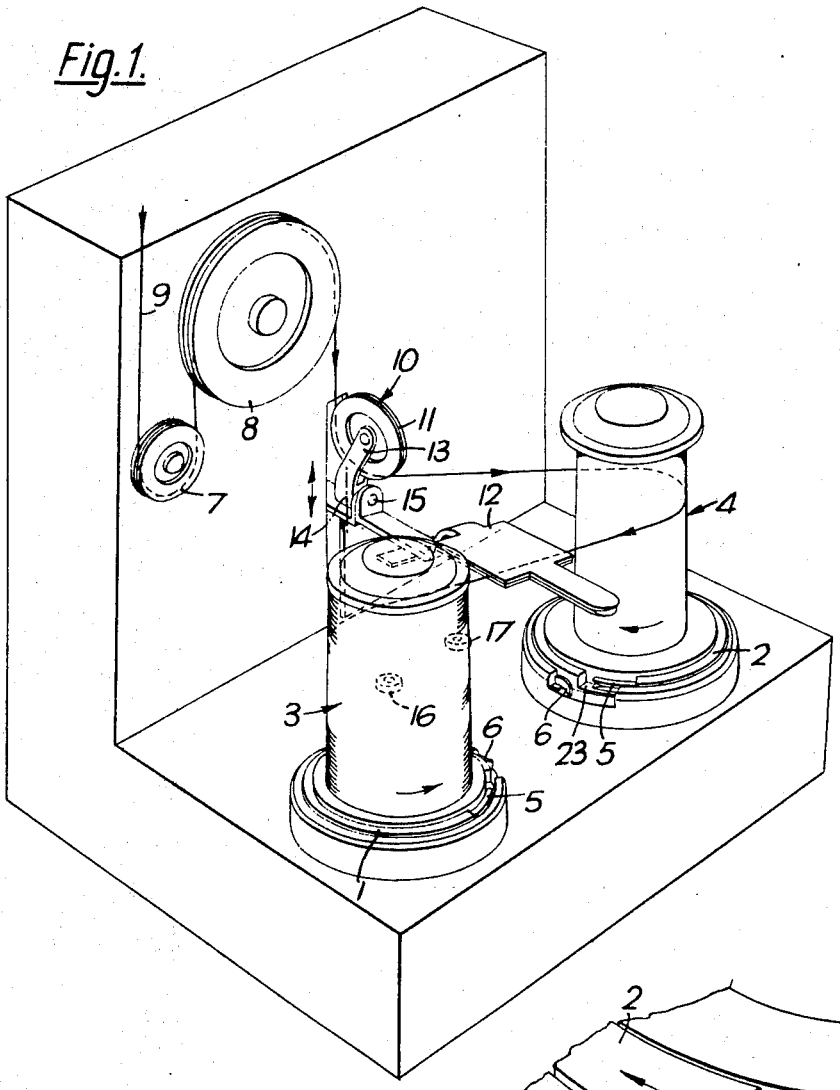
FIG. 1 is a perspective diagram of apparatus in accordance with the invention.

As seen in FIG. 1, the apparatus comprises two horizontal turntables 1, 2 each of which can support a respective take-up reel 3, 4. Each turntable is equipped with a torque motor for driving it in the direction indicated (opposite for the two turntables). Each turntable carries a recessed wire-gripping finger 5 and is associated with a fixed cutter 6. The apparatus also includes a guide pulley 7 and capstan 8 for the incoming wire 9, which may be taken from wire processing equipment of various kinds, but more especially from enamelling apparatus, and a traverse mechanism 10. This traverse mechanism includes a traverse pulley 11 and a spatulate guide 12, comprising two slightly spaced plates, extending between the two reels. The pulley and the spatulate guide are traversed in a vertical direction by a conventional traverse mechanism (not shown) in order to lay the wire evenly on the reel 3 or 4. The pulley is mounted in a clevis 13 which is freely rotatable about a vertical axis 14 in response to deflection of the wire. The bottom of the groove in pulley 11 is preferably adjustable relative to the spatulate guide 12 to ensure that spooling from the pulley to the spool or from the spatulate guide to the spool results in the same traverse lay on the spool. The spatulate guide 12 can be tilted about a horizontal pivot 15 (parallel to its axis) when at the lower end of its traverse motion, by solenoid actuators 16 and 17 as more fully described below.

Figure 3:
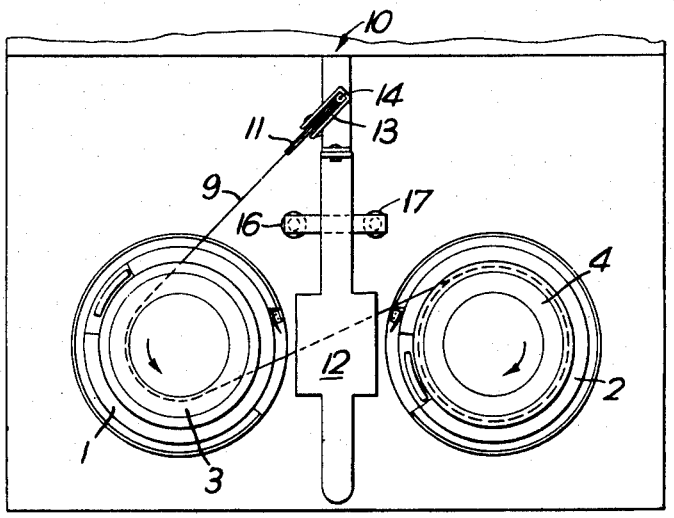
FIGS. 3, 4 and 5 are plans showing the apparatus at three stages of its operation.

As seen in FIG. 3, the wire 9 passes from the traverse pulley 11 part way round the reel 3 engaging the reel in a sufficient arc to ensure firm frictional contact so that the reel may be driven by the wire, and then between the plates of the spatulate guide 12 on to the reel 4 on which it is being wound. In this phase of operation the turntable 1 is driven by its torque motor so as to apply to the reel 3 only sufficient torque to overcome windage and frictional losses, whereas the turntable 2 is driven by its motor with a torque sufficient to maintain the required tension in the wire.

Figure 4:
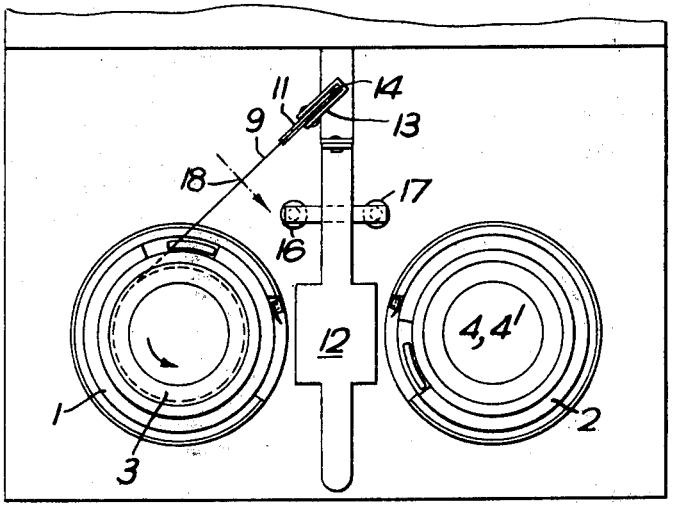

When the reel 2 is filled, the wire is cut and its leading end is transferred to the reel 3, as more fully described below; the turntable 1 now being driven at a torque sufficient to maintain required tension and the turntable 2 being stopped (FIG. 4). At any convenient stage during the filling of the reel 3, the full reel 4 can be removed and replaced by an empty reel 4'.

Figure 5:
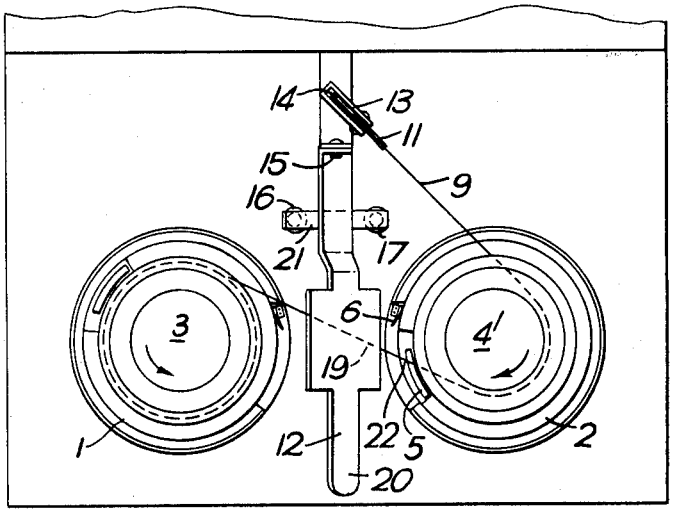

The turntable 2 is now run up to approximately the peripheral speed of the full reel speed, and the torque applied to it reduced to a level only sufficient to overcome friction. A loop is then formed by pulling on the wire 9 in the region 18 (with the finger or a suitable tool); one side 19 (FIG. 5) of the loop is passed between the plates of the spatulate guide 12 from its front end 20 and the loop is passed over the end of and engaged with the idling reel 4'. The torque applied to reel 4, the idler, can be deemed correct when the tensions as felt or measured at points 9 and 19 are substantially equal.

The condition of the apparatus is now the same as shown in FIG. 3 except for a "mirror reversal" interchanging the functions of the two turntables, and the process described will be repeated when reel 3 is full so as to wind on reel 4', and so on as required.

Figure 2:
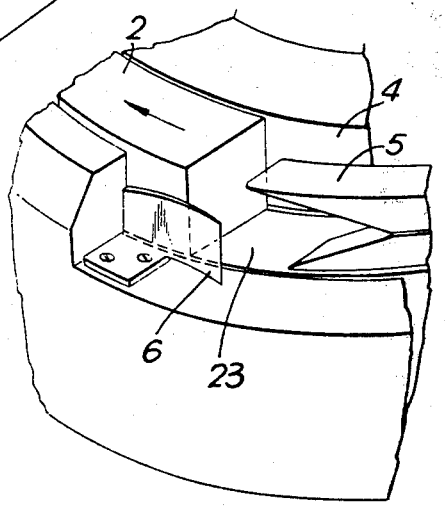
FIG. 2 is an enlarged detail of part of FIG. 1.
Figure 6:
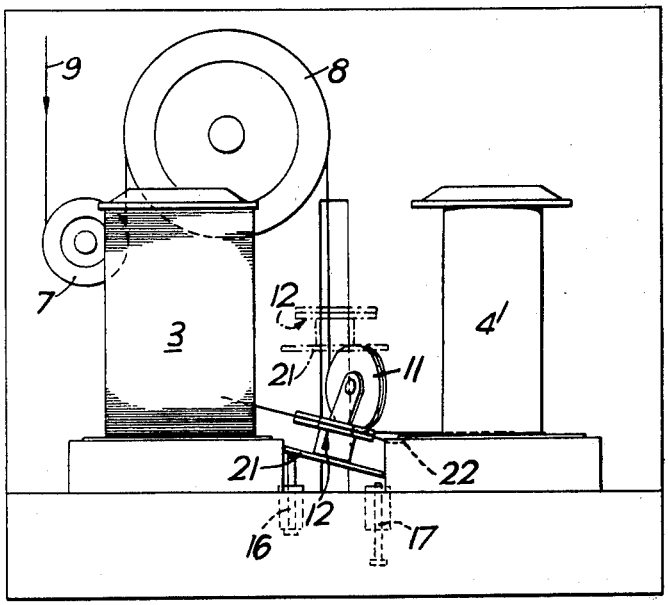
FIG. 6 is a front elevation of the apparatus at a stage of operation corresponding to FIG. 5.

The mechanism for changeover from winding on a filled reel to winding on an empty one will now be described with reference primarily to FIG. 6, which shows the apparatus during the changeover from reel 3 to reel 4'. Normally the spatulate guide 12 is in a horizontal position, as shown in chain dot in this Figure. When reel 3 is filled however, an enabling circuit is closed (by manual intervention or preferably by any of the several types of automatic detection mechanism) so that when the traverse mechanism next reaches the lower limit of its travel solenoid 16 operates and engages a lever 21 attached to the spatulate guide to twist the spatulate guide in a clockwise direction as shown in FIG. 6. This causes the wire to be deflected downwards at 22 where it extends below the bottom flange of the reel and when the appropriate angular position is reached into a recess 23 (FIGS. 1 and 2) where it is trapped by the finger 5, which both holds it and draws it into engagement with the cutter 6. The finger 5 continues to hold the cut leading end at least until winding is established on the reel 4' and normally until that reel is subsequently removed.

The change in the torque of the two motors is brought about automatically; preferably the torque applied to the empty reel is increased immediately the solenoid actuator 16 is operated, but unless the momentum of the full reel is high it is preferable to continue applying torque to it until the cutting and gripping process is complete; in practice that is until the turntable carrying the empty reel has made at least one full turn after operation of the solenoid actuator.

Changeover in the opposite direction is initiated by the solenoid actuator 17, and proceeds in exactly the same way.

An important advantage of the invention is that the reels used need not be identical in every respect. No adjustment is needed to allow the use of reels having barrels that differ in diameter, or to change from straight to tapered barrels. A simple adjustment of the traverse mechanism is required if the winding length of the reel changes, but in many cases this adjustment can be effected, without stopping the machine, during the first upward traverse on the new reel.

What I claim as my invention is:

1. Wire-winding apparatus comprising: means for supporting a pair of reels in fixed positions; means comprising a respective torque motor for driving each said reel to rotate about its axis; means for guiding a wire to pass at least partially round a reel in one of said fixed positions and thence on to a reel in the other of said fixed positions; means for cutting a length of said wire extending between a pair of reels when supported in said positions; co-acting with said cutting means, means for engaging the said length of wire to cause it to be cut by said cutting means and for guiding a leading cut end of said wire to the said reel in the said first position; and means for adjusting the torque of each said motor.

2. Wire-winding apparatus in accordance with claim 1 in which said means for supporting a pair of reels comprises a pair of turntables arranged in fixed positions side by side with axes of rotation that are substantially vertical.

3. Apparatus as claimed in claim 1 in which said torque adjusting means includes automatic means for increasing the torque applied to a reel when said leading cut end of the wire is applied to it.

4. Apparatus as claimed in claim 1 in which said means for guiding wire includes a wire guide for directing wire to either of said reels and means for reciprocating said guide relative to said means for supporting a pair of reels in a direction substantially parallel to their said axes.

5. Apparatus as claimed in claim 2 in which said means for guiding wire includes a wire guide for directing wire to either of said reels, said wire guide comprising a clevis pivoted on a vertical axis, a freely rotatable pulley mounted on a substantially horizontal axis of rotation in said clevis and means for reciprocating said guide vertically relative to said means for supporting a pair of reels.

6. Apparatus as claimed in claim 5 in which said guide means also includes an elongate guide which lies in a substantially horizontal plane aligned with the bottom of a peripheral wire-receiving groove of said pulley and which extends between the two said turntables in a direction substantailly normal to a plane containing the axes of rotation of the turntables.

7. Apparatus as claimed in claim 1 further comprising a cutting blade and in which said means for engaging the wire comprises at least one finger rotatable with a said means for supporting one of said pair of reels which, when brought into operation, engages wire between said reels to urge it against said cutting blade to cut the wire and retain engagement with said leading cut end of the wire to guide it to an empty reel mounted on that one said support.

* * * * *